US011867001B2

(12) United States Patent
Christensen

(10) Patent No.: US 11,867,001 B2
(45) Date of Patent: Jan. 9, 2024

(54) SYSTEM AND METHOD FOR CONNECTING A TERMINATION BODY TO A PORTION OF A RISER

(71) Applicant: Future Production AS, Kristiansand (NO)

(72) Inventor: Øystein Christensen, Kristiansand (NO)

(73) Assignee: Future Production AS, Kristiansand (NO)

( * ) Notice: Subject to any disclaimer, the term of this patent is extended or adjusted under 35 U.S.C. 154(b) by 0 days.

(21) Appl. No.: 17/774,242

(22) PCT Filed: Nov. 18, 2020

(86) PCT No.: PCT/NO2020/050283
§ 371 (c)(1),
(2) Date: May 4, 2022

(87) PCT Pub. No.: WO2021/101390
PCT Pub. Date: May 27, 2021

(65) Prior Publication Data

US 2022/0403707 A1 Dec. 22, 2022

(30) Foreign Application Priority Data

Nov. 18, 2019 (NO) ..... 20191367

(51) Int. Cl.
*E21B 17/01* (2006.01)
*E21B 17/08* (2006.01)

(52) U.S. Cl.
CPC ..... *E21B 17/01* (2013.01); *E21B 17/085* (2013.01)

(58) Field of Classification Search
CPC ..... E21B 17/01; E21B 17/085
See application file for complete search history.

(56) References Cited

U.S. PATENT DOCUMENTS

| | | | | |
|---|---|---|---|---|
| 4,668,126 | A * | 5/1987 | Burton | E21B 19/002 166/341 |
| 8,997,878 | B2 * | 4/2015 | Brown | E21B 19/004 166/341 |
| 9,970,247 | B2 | 5/2018 | Fraczek et al. | |
| 2011/0056701 | A1 | 3/2011 | Jones et al. | |
| 2013/0240214 | A1 * | 9/2013 | Faye | E21B 17/02 166/345 |
| 2013/0255956 | A1 * | 10/2013 | Gilmore | E21B 17/085 166/345 |

(Continued)

OTHER PUBLICATIONS

Norwegian Search Report for NO 20191367, dated Mar. 4, 2020.
International Search Report and the Written Opinion for PCT/NO2020/050283, dated Feb. 4, 2021.

*Primary Examiner* — Matthew R Buck
(74) *Attorney, Agent, or Firm* — Andrus Intellectual Property Law, LLP

(57) ABSTRACT

A system has a riser and a termination body, the termination body being arranged to connect at least one first conduit arranged along the riser and at least one second conduit extending from the riser to a drilling rig, where the termination body has a first clamp body and a second clamp body arranged for mutual joining and radial enclosure of a portion of the riser, and at least one receptacle block for connecting the at least first conduit, where the portion of the riser is unsplit. A method for connecting the termination body to the riser is also disclosed.

18 Claims, 6 Drawing Sheets

(56) References Cited

U.S. PATENT DOCUMENTS

| | | | | |
|---|---|---|---|---|
| 2014/0166299 | A1* | 6/2014 | Vatne | E21B 33/038 166/360 |
| 2016/0168926 | A1 | 6/2016 | Stibich et al. | |
| 2016/0230480 | A1* | 8/2016 | Jansen | E21B 19/004 |

* cited by examiner

SYSTEM AND METHOD FOR CONNECTING A TERMINATION BODY TO A PORTION OF A RISER

CROSS-REFERENCE TO RELATED APPLICATIONS

This application is the U.S. national stage application of International Application PCT/NO2020/050283, filed Nov. 18, 2020, which international application was published on May 27, 2021, as International Publication WO 2021/101390 in the English language. The International Application claims priority of Norwegian Patent Application No. 20191367, filed Nov. 18, 2019. The international application and Norwegian application are both incorporated herein by reference, in entirety.

FIELD

The present invention is related to a system comprising a riser and a termination body, where the termination body is arranged for a mutual joining and radial enclosure of a portion of the riser. The termination body being arranged to connect at least one first conduit arranged along the riser, and at least one second conduit extending from the riser to a drilling rig. Disclosed herein is also a method for connecting the termination body to the riser.

BACKGROUND

Typically, a drilling riser system used when a Blow Out Preventer (BOP) is located on a seabed comprises various riser elements, for instance riser joints, a telescopic joint, so-called pup joints, and other riser elements. The riser elements are typically bolted and/or locked together, forming a riser string.

Special purpose riser elements may be welded onto or into a riser element or bolted between two riser elements.

The special purpose riser element may comprise one or more connections for certain conduits, such as mud return conduits and hydraulic and electrical control lines. The conduits may be kill- and choke lines. The conduits may be a boost line. The special purpose riser element may also comprise means such as valves, actuators, and control lines for example hydraulic tubing and electric wiring, temperature sensors and pressure transducers. The conduits may comprise a fluid with a low pressure or a high pressure. Said conduits are typically connected to termination points on the riser element or a tailor-made termination body, being part of special purpose riser element.

A termination body by prior art is typically welded into a riser element, forming a special purpose riser element, by cutting a riser element into a first segment and a second segment and positioning the termination body between the two segments. Said operation is known to be complex and costly. A riser element has typically a length between 45 and 90 feet.

If there is a need to dismantle the termination body from the special purpose riser element, the termination body must be cut loose from the adjacent riser segments. Said operation is known to be complex and costly.

It is also known to add flanges directly to a first end portion and a second end portion of the termination body.

The special purpose riser element comprising the termination body, or a termination body with flanges, is connected to the riser string by a normal bolt connection. Since the termination body is a part of a riser element, extra logistics are needed to ensure that the special purpose riser element is available at the correct position at the correct time.

Patent document U.S. Pat. No. 9,970,247 discloses a special purpose riser element comprising a flange connection.

SUMMARY

The invention has for its object to remedy or to reduce at least one of the drawbacks of the prior art, or at least provide a useful alternative to prior art.

The object is achieved through features which are specified in the description below and in the claims that follow.

The invention is defined by the independent patent claims. The dependent claims define advantageous embodiments of the invention.

In a first aspect the invention relates to a system comprising a riser and a termination body, the termination body being arranged to connect at least one first conduit arranged along the riser and at least one second conduit extending from the riser to a drilling rig. The termination body comprises a first clamp body and a second clamp body arranged for mutual joining and radial enclosure of a portion of the riser, and at least one receptacle block for connecting the at least one first conduit and the at least one second conduit. The portion of the riser is unsplit.

By riser it is meant in this context a riser element and/or a riser segment, including a telescopic joint and a slip joint. Multiple riser elements bolted together form a riser string. The riser string may have an overall length more than 1000 meters.

By unsplit is meant in this context that the riser is not cut or split for receiving the termination body, unlike prior art. An effect of the unsplit riser, is that the termination body may be arranged to any riser element, unlike prior art which require especially made riser element which are welded into a split riser.

By conduit it is meant in this context a cable, a tube or a pipe. The tube and cable may comprise a fluid, for instance drilling mud, oil or gas. During drilling, a high pressure may occur in the well and pressurized fluid may flow through a safety valve in the BOP unit. The conduit may be a kill and choke line. Said conduit may be used to lead the pressurized fluid from the BOP valve and to the drilling rig without leaking fluid the sea. The fluid may have a low pressure, for instance 3000 psi. The fluid may have high a pressure, for instance 15000 psi. Said cable may be a power cable.

A first conduit and an associated second conduit form a pair of conduits. The termination body may comprise connections for one or more pairs of conduits. The termination body may comprise connections for different kinds of conduits, such as low-pressure conduits, high-pressure conduits pairs and electrical conduits. The electric conduit may be an electric cable. The conduits may be connected to the conduit connections by means of prior art, for instance by a bolt connection or a clamp connection. The first conduit may be connected to a BOP (blow out preventer).

By mutual joining it is meant in this context a pairing, fixation or a locking of the at least two clamp bodies to each other.

An effect of the two clamp bodies being arranged for mutual joining and radial enclosure of the portion of the riser, is that the termination body can be arranged to a riser without separating the riser in a first riser segment and a second riser segment as required by prior art, meaning that no cutting and associated welding is needed for arranging the termination body to the riser. When the riser is uncut/unsplit, the structural strength of the riser element may stay intact.

The advantage with two clamp bodies only, is as less joints as possible between the clamp bodies.

Since a standard riser element may be used for receiving the termination body, the invention simplifies logistics and reduce cost and down time when installing the termination body.

In an alternative embodiment, the termination body may comprise three or more clamp bodies, each of the three or more clamp bodies may have an equal gradient sector, for instance 3 times 120 degrees, or an unequal gradient sector, for instance 180 degrees, 120 degrees, and 60 degrees.

An interface between the clamp bodies may be a plane intersecting with a centre axis of the riser. The interface may not intersect with the centre axis. The interface between two clamp bodies may be arranged in one or more planes.

The termination body may be arranged for a being releasably attached to the riser.

By releasably attached it is meant in this context that the termination body is arranged for being loosened from the riser when required, for instance when servicing the termination body or moving the termination body from a first riser to a second riser.

The effect of the releasable attachment is that the termination body can easily be dismantled from the riser and without use of cutting tools. The releasable positioning is time and cost saving and improves the safety, for instance as no hot work is needed.

A termination body arranged for a releasable attachment to the riser may comprise suitable means for connecting the clamp bodies together, such as a bolt connection or similar. The clamp bodies may be connected to each other by a bolt connection or likewise creating a friction force between the clamp bodies and the riser, the frictional force being large enough to prevent the clamp bodies from moving along the riser. The clamp bodies may comprise a surface portion arranged for increasing the friction towards the riser.

Each of the first clamp body and the second clamp body may comprise at least one abutment surface arranged to lie supportive against the riser or an element surrounding the riser. The abutment surfaces may have an inner radius corresponding with an outside radius of the riser.

By corresponding means in this aspect that the inner radius is at equal to or larger than the outside radius of the riser. In one embodiment, the inner radius and the outer radius are equal, within required tolerances. In an alternative embodiment, a bushing may be positioned between the riser and the clamp bodies. The bushing may be arranged to even out possible irregularities on the abutment surface on the riser and/or the clamp bodies.

If the clamp bodies are connected to an existing collar on a riser, the abutment faces may be outside the riser, and the corresponding radius may be set by the shape and diameter of said collar.

The mutual joining between the clamp bodies may be a permanent connection, for instance a weld. At least two clamp bodies may be welded to each other. At least one clamp body may be welded to the riser.

The termination body may be permanently fixed to the riser by using suitable means, for instance welding.

The riser may comprise means for preventing the termination body to slide along the riser in an axial direction. Said means may for instance be a collar or a block arranged to the portion of the riser. Said means may be welded to the outside of the riser. Since heat work is done on the outside of riser only, the structural strength of the riser will not be reduced.

Said means may be a collar or likewise used in a previous application on the riser, for instance holding a conduit in position. The clamp bodies may be tailor made so an existing collar or likewise on a riser may be used to keep the clamp bodies in the vertical position. This enables the system described herein to be retrofit on any riser, slip joint or telescopic joint without splitting said riser, slip joint or telescopic joint.

The receptacle block comprises connections for the first conduit and the second conduit and fluid channel enabling a fluid to flow between the first conduit and the second conduit. When the first conduit and the second conduit are connected to the receptacle block, a fluid may flow between for instance a BOP and the drilling rig.

The receptacle block may be an integrated part of the termination body. The receptacle block may be an integrated part of a clamp body. By integrated it is meant in this context that the receptacle block is permanently attached to the termination body or the clamp body. If the clamp body is made from a solid block, said inlets, outlets and fluid channels may be formed in the solid block. In an alternative embodiment, the receptacle block may be fixed by welding or other suitable means for permanent attachment to the clamp body.

A termination body may comprise one or more receptacle blocks. At least two receptacle blocks may have a different design.

In a second aspect the invention relates to a termination body describe in the first aspect of the invention.

At least one receptacle block may be releasably attached to one of the clamp bodies.

The effect of the releasable attachment of the receptacle block is that the receptacle block can be replaced independently of the clamp bodies, for instance during service or if more or fewer conduits are required, or if a larger or smaller conduit is needed.

The releasable attachment may comprise a sliding rail connection. The releasable attachment may comprise a bolt connection.

The termination body may comprise means for engaging with corresponding means on the riser for preventing the termination body from moving in at least one direction along the riser.

The effect of said engagement is that the termination body can be kept in an axial position regardless of the friction between the clamp bodies and the riser. When the termination body is mounted to the riser, it is essential that the termination body is kept permanently in a correct position to avoid stress and damages on the conduits connected to the termination body.

Said means on the riser may be a collar enclosing a portion of the riser, where the collar is fixed to the riser, for instance by welding. The collar, in an operative position having an upward abutment surface and a downward abutment surface. The upward abutment surface may be annular. The downward abutment surface may be annular.

The clamp body may have a recess, in an operative position forming an upward abutment surface and a downward abutment surface. The recess may have an inner diameter corresponding with the outer diameter of the collar. When the termination body is positioned to the riser, the upper abutment of the clamp body may rest against the upper abutment surface of the collar. The collar may be designed for carrying the whole weight of the termination body with necessary safety margin.

Usually, the lower abutment surfaces may not be in contact with each other, as an axial height of the recess should be higher than the axial height of the collar for giving necessary clearance during assembly. The mass weight of the termination body should in normal operating conditions prevent an upwards movement of the termination body. The lower abutment surfaces will however prevent a damaging upwards movement of the termination body in case of an incident.

In an alternative embodiment, the termination body may rest on at least one protruding element fixed on the riser. The protruding element may be positioned under the termination body. The protruding element may be a collar or a block.

The termination body may comprise means for preventing the termination body from rotating around the riser.

The effect of preventing said rotation, is that the conduits will be kept in their set positions to reduce or eliminate any risk of damage on the components due to a rotation of the termination body.

Said rotation preventing means may be a rotational lock. The rotational lock may be a male-female coupling. At least one clamp body may comprise a recess arranged to enclose a corresponding protruding element on the riser. The rotational lock may be a protruding portion of a clamping block, the protruding portion arranged to engage with a corresponding recess in the collar.

The receptacle block may comprise at least one connection for the first conduit being arranged perpendicularly to at least one corresponding connection for the second conduit.

The effect of the perpendicular positioning of said connections is that a first conduit may be connected to the termination body in line with the riser, and a second conduit may be connected horizontally to the termination body when the termination body is in an operative position. The applicant's own gooseneck handling system is an example of a connection of a conduit connected perpendicular to the riser. The benefit of a horizontal connection is that it is easier for the operator to see the connection, compared to a vertical connection where the conduit must be connected upwards along the riser.

The termination body may comprise at least one receptacle block comprising a housing for receiving an alignment means for a connection body.

The connection body collects multiple conduits in one body, so the multiple conduits may be connected to the termination body in one operation. The connection body may be a part of a gooseneck handling system. The alignment means may for instance be a pin for the gooseneck handling system.

The effect of the housing is that a connection body can be positioned correctly to the termination body and with high accuracy as the housing and the pins guide the connecting body into a correct position, ensuring that all connections are correct and not leaking.

In another aspect the invention relates more particularly to a coupling system for connecting a first conduit arranged along a riser and a second conduit extending from the riser to a drilling rig, where the coupling system comprises a termination body according to the first aspect of the invention.

In a further aspect the invention relates more particularly to a method for connecting the termination body according to the first aspect of the invention to a riser, where the method comprises the steps of:

arranging the clamp bodies around a portion of the riser;

joining the clamp bodies to each other;

connecting at least one first conduit to at least one corresponding first conduit connection on the receptacle block; and connecting at least one second conduit to at least one corresponding second conduit connection on the receptacle block, so that a fluid may flow between the at least one first conduit and the at least one second conduit.

BRIEF DESCRIPTION OF THE DRAWINGS

In the following is described an example of a preferred embodiment illustrated in the accompanying drawings, wherein.

DETAILED DESCRIPTION OF THE DRAWINGS

Figure 1:
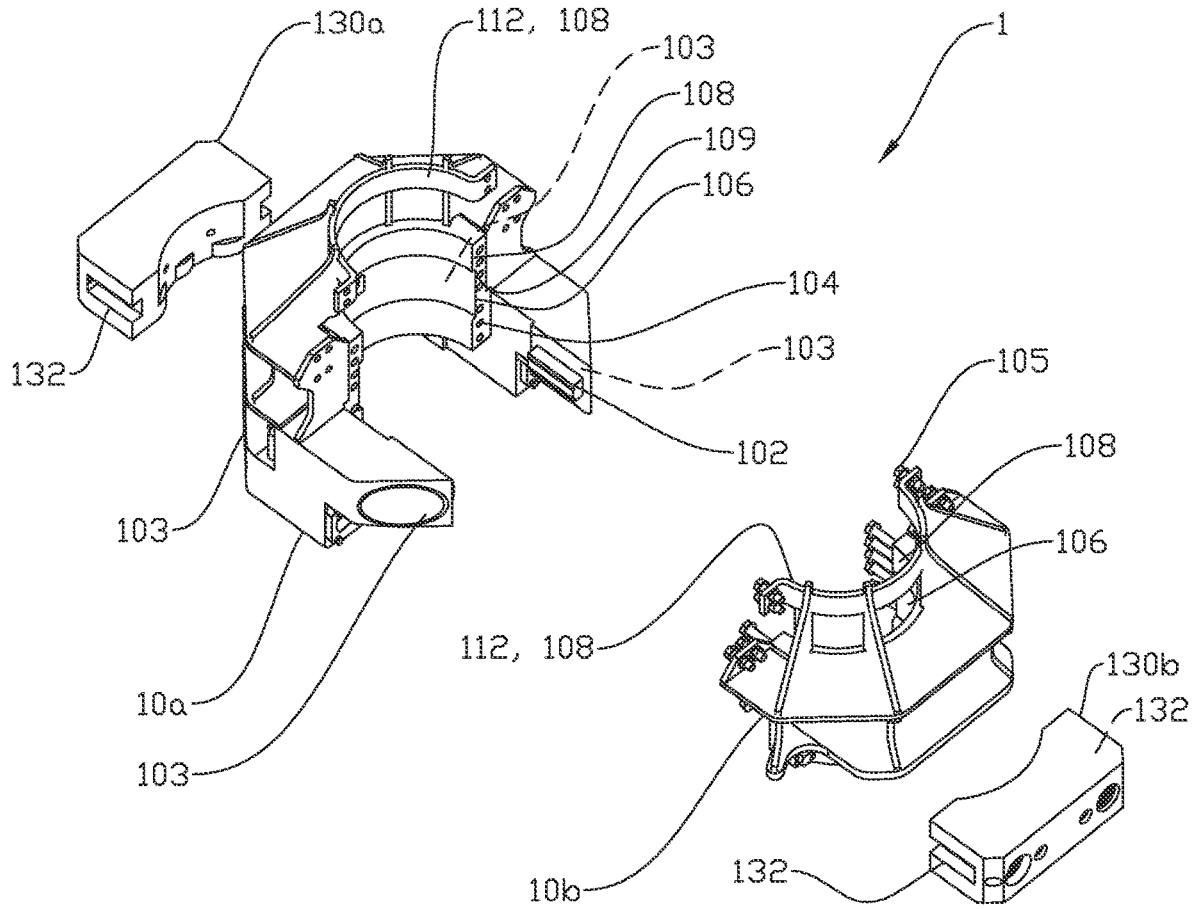
FIG. 1 shows an exploded view of a termination body.

FIG. 1 shows a termination body 1 for a riser 9 (FIGS. 3-6). The termination body 1 is multi sectional, comprising a first clamp body 10*a* and a second clamp body 10*b*, a first receptacle block 130*a* and a second receptacle block 130*b*.

The two clamp bodies 10*a*, 10*b* are arranged for a mutual joining and a radial enclosure of a portion of the riser 9. The receptacle blocks 130*a*, 130*b* illustrated are arranged for being connected to the first clamp body 10*a*, where a pair of recesses 132 in the receptacle blocks 130*a*, 130*b* corresponds with a pair of sliding rails 102 in the first clamp body 10*a*.

A bolt connection 105 comprising multiple bolts locks first clamp body 10*a* with the second clamp body 10*b*. The bolt connection 105 may create a bias for creating friction between the clamp bodies 10*a*, 10*b* and the riser 9. The friction helps to hold the termination body 1 to the riser 9.

The first clamp body 10*a* and a second clamp body 10*b* comprise at least one abutment surface 108 arranged to lie supportive against the riser 9. The abutment surfaces 108 have an inner radius corresponding with an outside radius of the riser 9. Each of the illustrated clamp bodies 10*a*, 10*b* comprises three abutment surfaces 108, whereof one of the said abutment surfaces 108 is shaped as a clamping bracket 112.

The termination body 1 comprises means for engaging with corresponding means on the riser 9 for preventing the termination body 1 to move in at least one direction along a centre axis 9X of the riser 9. On the illustrated embodiment, said means is a recess 106 arranged to engage with a collar 91 (FIG. 3) arranged on the outside of the riser 9. The inner radius of the recess 106 corresponds with the outer radius of the collar 91. When connected to the riser 9, a first surface 109 of the recess 106 lies supportively against a corresponding surface 910 on the collar 91, keeping the termination body 1 in a fixed axial position.

The first clamp body 10*a* illustrated is formed from a compact block. The second clamp body 10*b* illustrated is formed by sheet metal plates.

Figure 5:
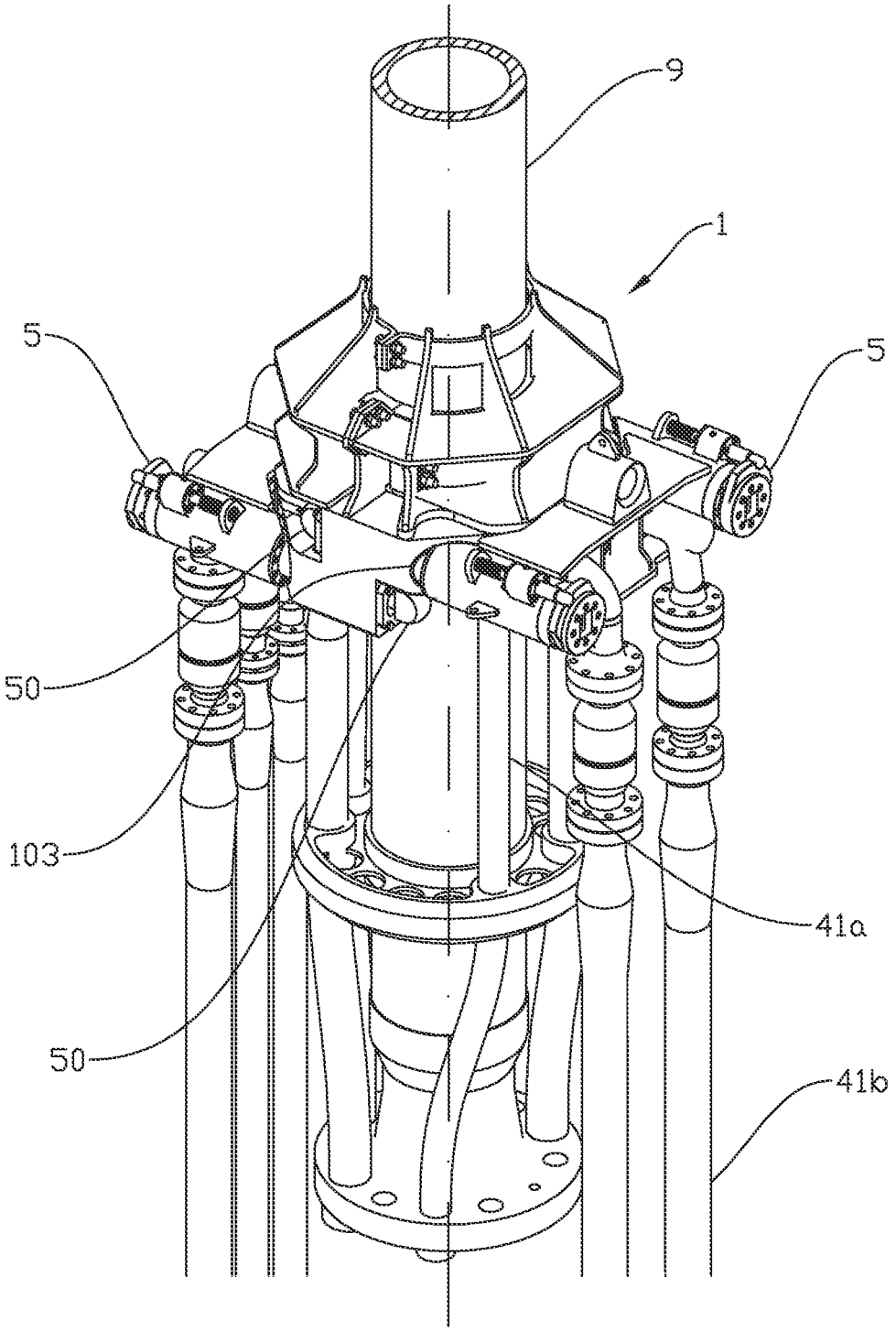
FIG. 5 shows a first high-pressure conduit connected with a second high-pressure conduit.

The first clamp body 10*a* comprises guide sleeves 103 arranged to receive corresponding alignment means 50 for a connection body 5 (FIG. 5. The connection body 5 illustrated in FIG. 5 illustrates the applicant's own connection body 5, referred to as a click stab connection body.

Figure 2:
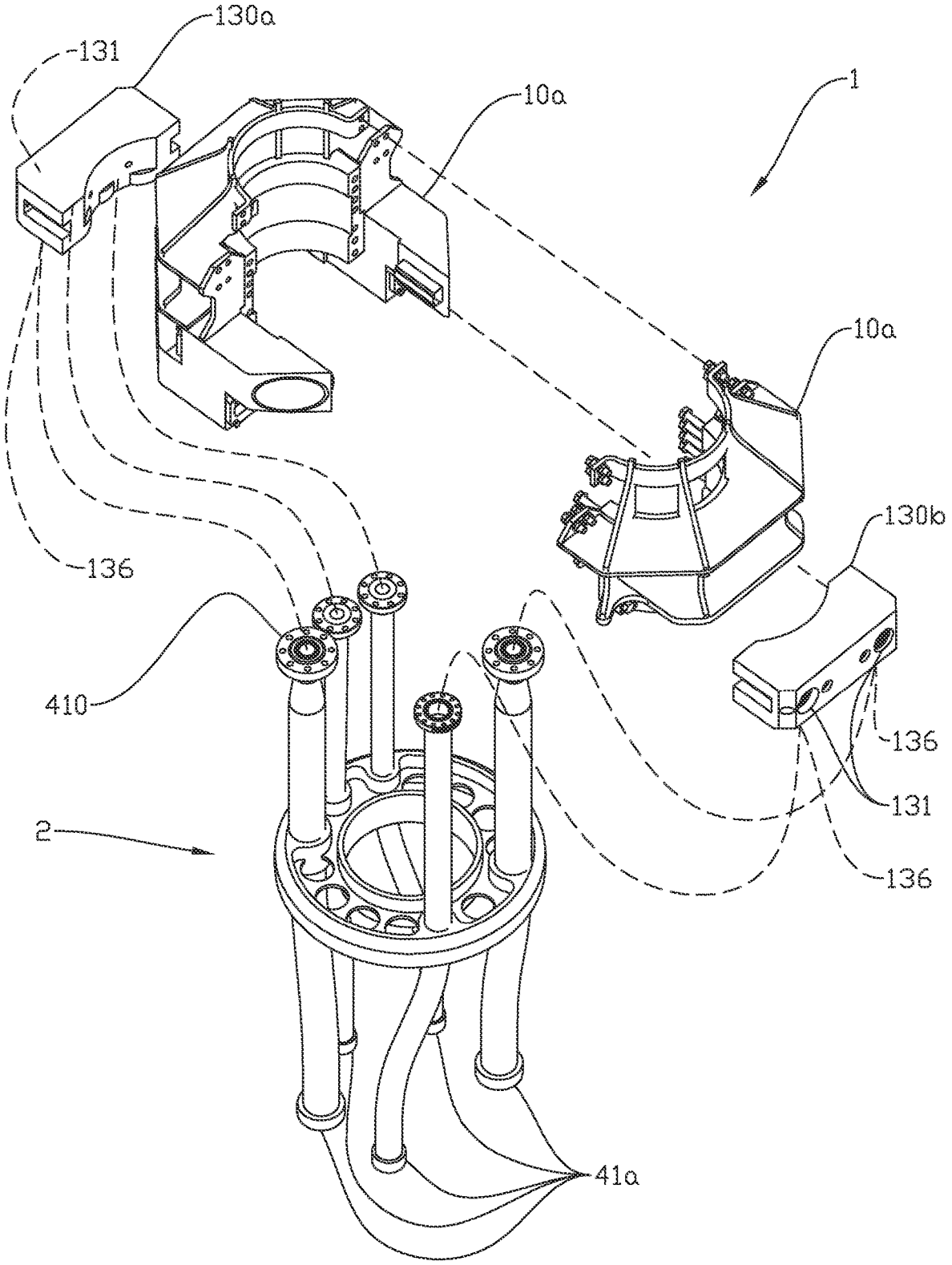
FIG. 2 shows the termination body and a pipe arrangement comprising a plurality of first conduits.

FIG. 2 shows the connections between the receptacle blocks 130*a*, 130*b* and the first conduits 41*a*. The first receptacle block 130*a* is illustrated with three first conduit connections 136 and three corresponding second conduit connections 131. The second receptacle block 130*b* is illustrated with two first conduit connections 136 and two second conduit connections 131. The first conduit connections 136 are arranged to receive a connection portion 410 of the first conduits 41*a*. In an alternative embodiment (not shown) the connection portion 410 may comprise a stab coupling having a diameter which is equal to or less than the first conduits 41*a*.

The second conduit connections 131 are arranged to receive corresponding conduit connection (not shown) being part of the connection body 5 shown in FIG. 5. The first conduit connections 136 are vertically arranged on an underside of the receptacle blocks 130*a*, 130*b* when the receptacle blocks 130*a*, 130*b* is in an operative position as illustrated. The second conduit connections 131 are horizontally arranged when the receptacle blocks 130*a*, 130*b* is in an operative position as illustrated. The first conduits 41*a* is supported by a pipe arrangement 2 arranged below the termination body 1.

Fluid channels (not shown) inside the receptacle blocks 130*a*, 130*b* enable a fluid to flow between the first conduits 41*a* and the corresponding second conduits 41*b* (FIG. 5). The first conduits 41*a* are shown with different diameters to illustrate that different conduits may be used.

Figure 3:
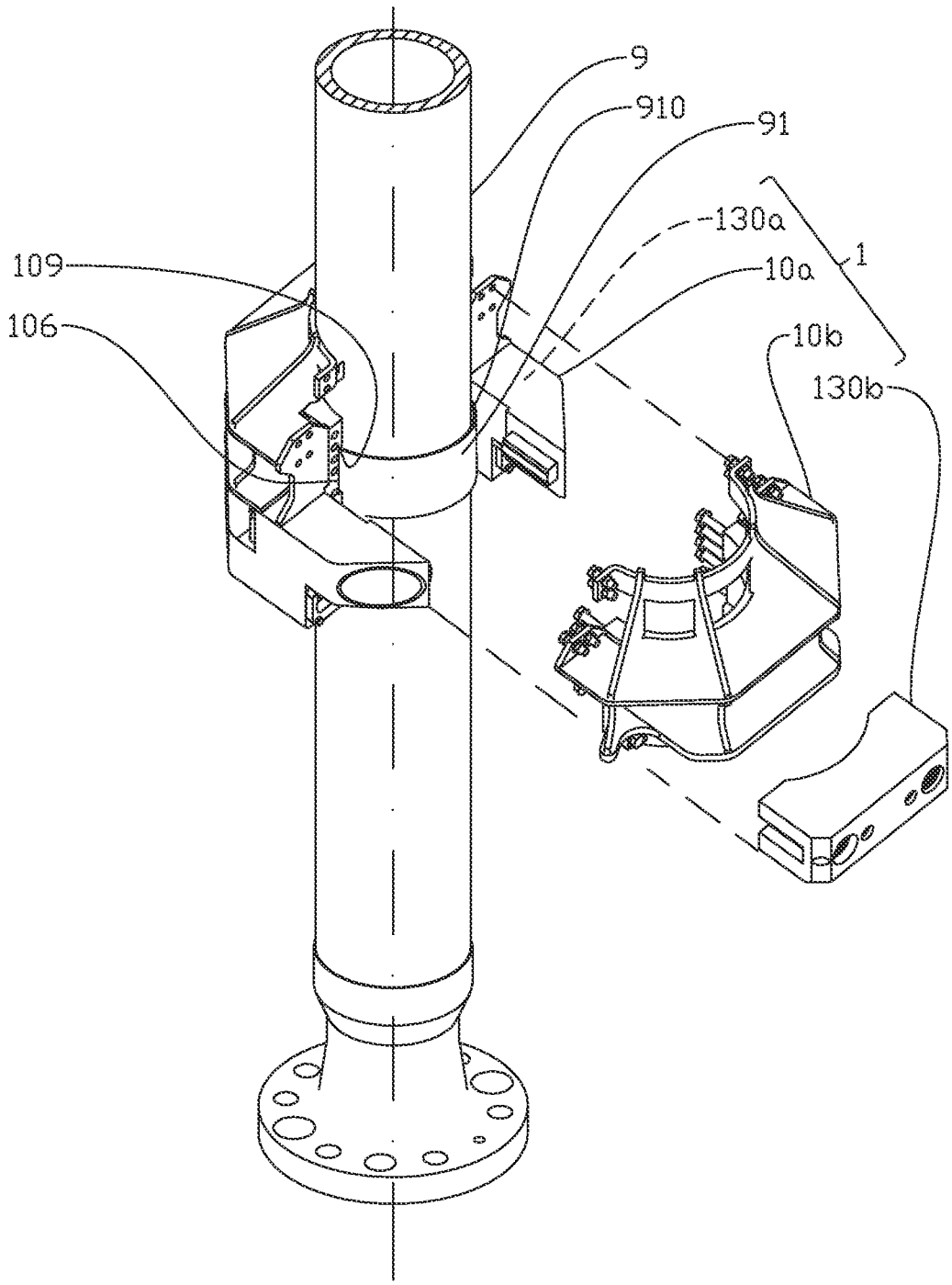
FIG. 3 shows the termination body being positioned to the riser.

FIG. 3 shows the first clamp body 10*a* positioned on the riser 9. The first surface 109 being part of the recess 106 is supported vertically by the corresponding surface 910 on the collar 91. The collar 91 is welded to the riser 9 designed to support the whole weight of the termination body 1. In FIG. 3, the first receptacle block 130*a* (hidden) is positioned into the first clamp body 10*a*. The receptacle blocks 130*a*, 130*b* may be dismantled from the termination body 1 in case of service or repair. The receptacle blocks 130*a*, 130*b* are locked to the first clamp body 10*a* by a bolt connection (not shown).

Figure 4:
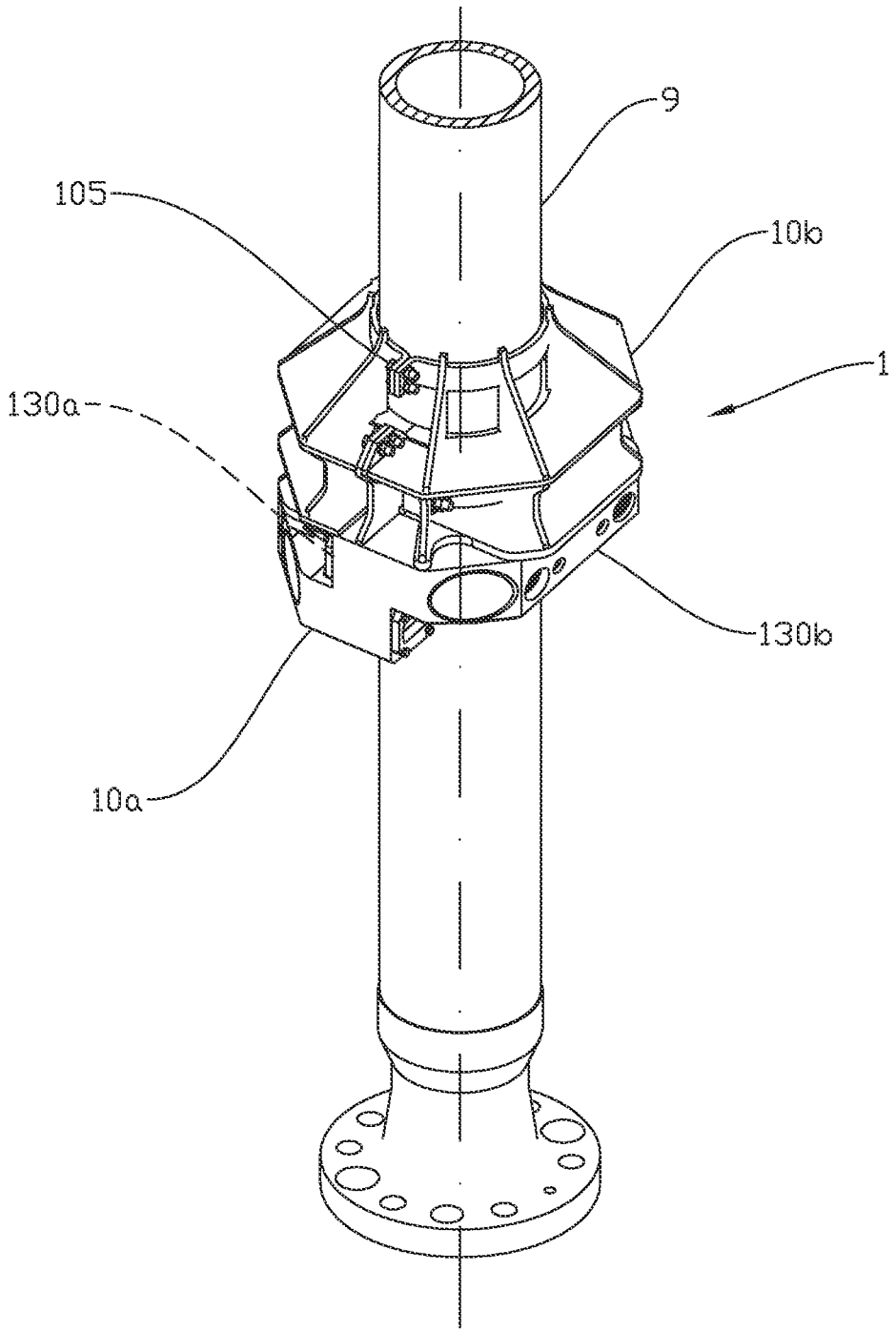
FIG. 4 shows the termination body positioned to the riser.

FIG. 4 shows the first clamp body 10*a* and the second clamp body 10*b* arranged to the riser 9, and the first receptacle block 130*a* (hidden) and the second receptacle block 130*b* positioned into the first clamp body 10*a*, forming the termination body 1.

FIG. 5 shows the termination body 1 in an operative position above the pipe arrangement 2. It should be noted that the pipe arrangement 2 may be present but is not shown in FIGS. 3 and 4.

When connecting the termination body 1 to the riser, the pipe arrangement 2 may be lowered along the riser to avoid any undesirable interaction between the termination body 1 and the conduits 41*a*. When the termination body 1 is fixed to the riser 9, the first conduits 41*a* may be raised and connected to the receptacle blocks 130*a*, 130*b* as illustrated. The second conduits 41*b* are connected to the receptacle blocks 130*a*, 130*b* via two connection bodies 5. The connection bodies 5 may be mounted by a hydraulically operated arm (not shown). The connection bodies 5 may be mounted by manual labour.

The connection bodies 5 illustrated comprises alignment means 50 positioned in corresponding guide sleeves 103 on the termination body 1. The alignment means 50 locks the connection bodies 5 to the termination body 1.

Figure 6:
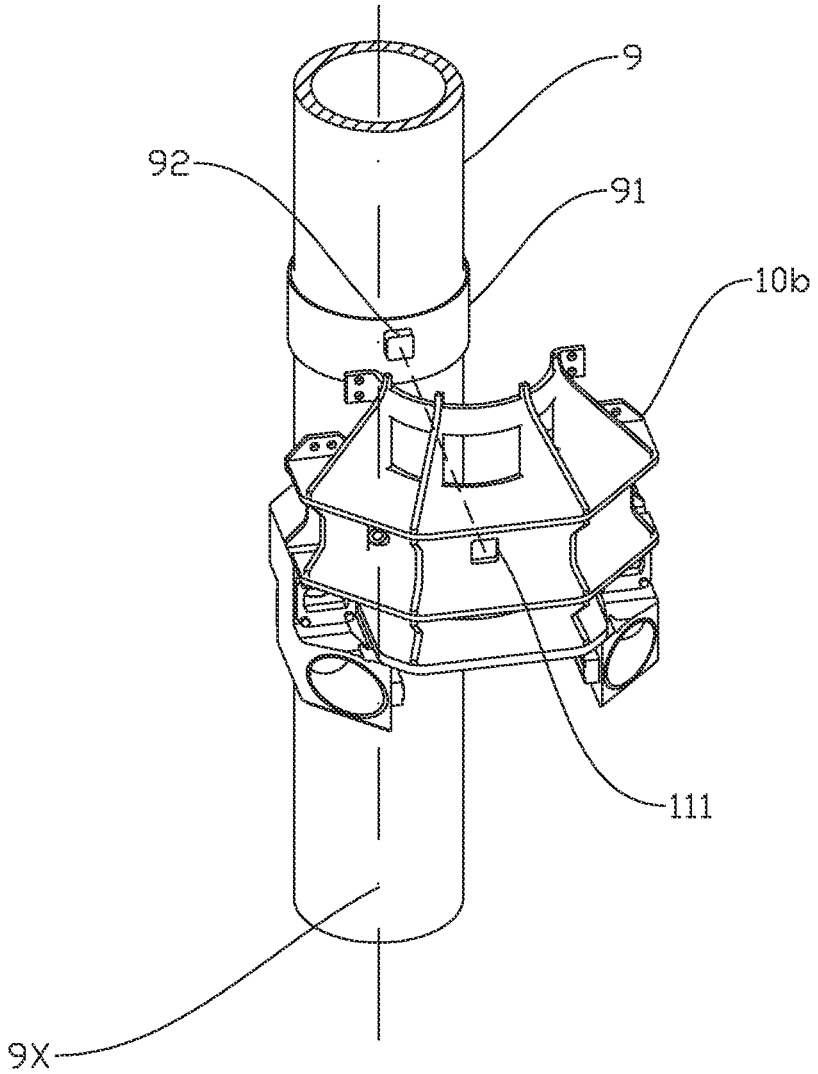
FIG. 6 shows a rotational lock.

FIG. 6 shows an embodiment of means for preventing the termination body 1 from rotating around the centre axis 9X of the riser 9. The means illustrated in FIG. 6 comprises a block 92 arranged to the collar 91, arranged to engage with a corresponding recess 111 arranged in the second clamp body 10*b*. When the second clamp body 10*b* is positioned to the riser 9, the engagement between the block 92 and the recess 111 prevents the termination body 1 from rotating around the centre axis 9X.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The invention claimed is:

1. A system comprising a riser and a termination body, the termination body being arranged to connect at least one first conduit arranged along the riser and at least one second conduit extending from the riser to a drilling rig, wherein the termination body comprises:

i) a first clamp body and a second clamp body arranged for mutual joining and radial enclosure of a portion of the riser which is unsplit, ii) at least one receptacle block for connecting the at least one first conduit and the at least one second conduit; and iii) means for engaging with corresponding means on the riser for preventing the termination body from moving in at least one direction along the riser.

2. The system according to claim 1, wherein the termination body is arranged for being releasably attached to the riser.

3. The system according to claim 2, wherein each of the first clamp body and the second clamp body comprise at least one abutment surface arranged to lie supportive against the riser or an element surrounding the riser.

4. The system according to claim 1, wherein each of the first clamp body and the second clamp body comprise at least one abutment surface arranged to lie supportive against the riser or an element surrounding the riser.

5. A termination body for use in a system comprising a riser and the termination body, the termination body being arranged to connect at least one first conduit arranged along the riser and at least one second conduit extending from the riser to a drilling rig, wherein the termination body comprises:

i) a first clamp body and a second clamp body arranged for mutual joining and radial enclosure of a portion of the riser which is unsplit, ii) at least one receptacle block for connecting the at least one first conduit and the at least one second conduit; and iii) means for engaging with corresponding means on the riser for preventing the termination body from moving in at least one direction along the riser.

6. The termination body according to claim 5, wherein the at least one receptacle block is releasably attached to at least one of the first clamp body and the second clamp body.

7. The termination body according to claim 5, wherein the termination body comprises means for preventing the termination body from rotating around the riser.

8. The termination body according to claim 6, wherein the termination body comprises means for preventing the termination body from rotating around the riser.

9. The termination body according to claim 5, wherein the at least one receptacle block comprises a housing for receiving an alignment means for a connection body.

10. A method for connecting the termination body according to claim 5, to the riser, wherein the method comprises the steps of:

arranging the first clamp body and the second clamp body around the portion of the riser;

joining the first clamp body and the second clamp body to each other;

connecting at the least one first conduit to at least one corresponding first conduit connection on the receptacle block; and connecting the at least one second conduit to at least one corresponding second conduit connection on the receptacle block, so that a fluid may flow between the at least one first conduit and the at least one second conduit.

11. A coupling system for connecting a first conduit arranged along a riser and a second conduit extending from the riser to a drilling rig, wherein the coupling system comprises:

a termination body, the termination body being arranged to connect at least one first conduit arranged along the riser and at least one second conduit extending from the riser to the drilling rig, wherein the termination body further comprises:

i) a first clamp body and a second clamp body arranged for mutual joining and radial enclosure of a portion of the riser which is unsplit, and ii) at least one receptacle block for connecting the at least one first conduit and the at least one second conduit;

wherein the termination body is mounted on the riser and further comprises means for engaging with corresponding means on the riser for preventing the termination body from moving in at least one direction along the riser.

12. A system comprising a riser and a termination body, the termination body being arranged to connect at least one first conduit arranged along the riser and at least one second conduit extending from the riser to a drilling rig, wherein the termination body comprises:

i) a first clamp body and a second clamp body arranged for mutual joining and radial enclosure of a portion of the riser which is unsplit, and ii) at least one receptacle block for connecting the at least one first conduit and the at least one second conduit;

wherein the at least one receptacle block comprises a housing for receiving an alignment means for a connection body.

13. The system according to claim 12, wherein the termination body is arranged for being releasably attached to the riser.

14. The system according to claim 12, wherein each of the first clamp body and the second clamp body comprise at least one abutment surface arranged to lie supportive against the riser or an element surrounding the riser.

15. A termination body for use in a system comprising a riser and the termination body, the termination body being arranged to connect at least one first conduit arranged along the riser and at least one second conduit extending from the riser to a drilling rig, wherein the termination body comprises:

i) a first clamp body and a second clamp body arranged for mutual joining and radial enclosure of a portion of the riser which is unsplit, and ii) at least one receptacle block for connecting the at least one first conduit and the at least one second conduit;

wherein the at least one receptacle block comprises a housing for receiving an alignment means for a connection body.

16. The termination body according to claim 15, wherein the termination body comprises means for preventing the termination body from rotating around the riser.

17. A method for connecting the termination body according to claim 15 to the riser, wherein the method comprises the steps of:

arranging the first clamp body and the second clamp body around the portion of the riser;

joining the first clamp body and the second clamp body to each other;

connecting the at least one first conduit to at least one corresponding first conduit connection on the receptacle block; and connecting the at least one second conduit to at least one corresponding second conduit connection on the receptacle block, so that a fluid may flow between the at least one first conduit and the at least one second conduit.

18. A coupling system for connecting a first conduit arranged along a riser and a second conduit extending from the riser to a drilling rig, wherein the coupling system comprises:

a termination body, the termination body being arranged to connect at least one first conduit arranged along the riser and at least one second conduit extending from the riser to the drilling rig, wherein the termination body further comprises:

i) a first clamp body and a second clamp body arranged for mutual joining and radial enclosure of a portion of the riser which is unsplit, and ii) at least one receptacle block for connecting the at least one first conduit and the at least one second conduit;

wherein the termination body is mounted on the riser and further wherein the at least one receptacle block comprises a housing for receiving an alignment means for a connection body.

* * * * *